US005547634A

United States Patent [19]

Hibbins et al.

[11] Patent Number: 5,547,634

[45] Date of Patent: Aug. 20, 1996

[54] METHOD FOR ADDING ALUMINUM AND CALCIUM TO MOLTEN LEAD

[75] Inventors: Stephen G. Hibbins, Renfrew; Fernando A. Timpano, Pembroke; Douglas J. Zuliani, Stittsville, all of Canada

[73] Assignee: Timminco Limited, Toronto, Canada

[21] Appl. No.: 351,225

[22] Filed: Nov. 30, 1994

Related U.S. Application Data

[63] Continuation-in-part of Ser. No. 240,062, May 9, 1994, abandoned.

[30] Foreign Application Priority Data

Sep. 20, 1994 [CA] Canada ..... 2132485

[51] Int. Cl.[6] ..... C22C 1/02

[52] U.S. Cl. ..... 420/564; 75/702; 420/590

[58] Field of Search ..... 420/564, 590; 75/701, 702; 266/235, 204, 216

[56] References Cited

U.S. PATENT DOCUMENTS

| | | | |
|---|---|---|---|
| 1,386,503 | 8/1921 | Hulst | 75/701 |
| 1,583,495 | 5/1926 | Schleicher | 75/701 |
| 1,706,722 | 3/1929 | York | 75/701 |
| 2,067,394 | 1/1937 | Hall | 266/235 |
| 3,741,754 | 6/1973 | Mainland | 420/564 |
| 4,052,200 | 10/1977 | Ward | 75/701 |
| 4,439,398 | 3/1984 | Prengaman | 420/590 |

*Primary Examiner*—Melvyn Andrews
*Attorney, Agent, or Firm*—Nixon & Vanderhye

[57] ABSTRACT

Process and apparatus for adding calcium and aluminum to molten lead to produce a lead-calcium alloy suitable for battery grids. Particles of calcium and aluminum metal or alloys thereof are fed into the interior of a tubular housing having a wall extending down into the molten lead and having a bottom opening at a relatively large depth below the lead surface and having openings in its wall at a relatively small depth below the lead surface. A rotary impeller which acts at least partially as a centrifugal impeller is positioned in the housing to cause swirling of lead carrying the particles within the housing, the shape of the housing and the nature and position of the impeller being such as to ensure that lead carrying the particles is swirled against the housing wall and recirculated within the housing before the lead leaves the housing.

7 Claims, 2 Drawing Sheets

130
129
112a
111a
Ca
Aℓ
112
111
124
113
116
118
118
132
119
116a
125
128
117

METHOD FOR ADDING ALUMINUM AND CALCIUM TO MOLTEN LEAD

CROSS-REFERENCE RELATED APPLICATION

This application is a continuation-in-part application of Application 08/240,062, filed May 9, 1994 now abandoned.

BACKGROUND OF THE INVENTION

1. Field of the Invention

This invention relates to a method for simultaneous addition of aluminum and calcium and alloys thereof to molten lead for the production of lead-calcium alloys.

2. Prior Art

Lead acid batteries historically have been produced with lead-antimony alloy grids. These lead-antimony batteries generate hydrogen gas through a chemical reaction with water in the electrolyte. This necessitates venting the battery and periodic replenishment of the water.

The introduction of lead-calcium alloy grids was a major development since these alloys greatly reduce the amount of hydrogen gas generated by the electrochemical reaction. As little as 0.1% calcium in the lead alloy is sufficient to reduce gassing to a level where the battery can virtually be sealed and no water additions are required.

The addition of calcium metal to lead is rather straightforward and can be accomplished by several methods including the simple addition of pure calcium metal or calcium alloys to the surface of a lead bath. Stirring the lead promotes better dissolution and minimizes opportunities for calcium oxidation as it floats on the surface of the lead melt.

U.S. Pat. No. 3,741,754, which issued Jun. 26, 1973 to C. M. Mainland, describes a process for adding granulated calcium metal to lead under an inert protective gas covering thereby minimizing oxidation of calcium during the addition. This process has the advantage of enabling calcium to be added to lead with high recovery and minimal fuming, emissions, flaring and losses to oxidation.

Alternatively, calcium may be introduced by adding calcium carbide as in U.S. Pat. No. 1,941,534 to Betterton, which issued Jan. 2, 1934.

The metallurgical difficulty with producing lead-calcium alloys is not in general related to the addition of calcium to molten lead since, as discussed above, there are several alternative alloying methods. The major problems relate to the fade of calcium once it has been dissolved in the liquid lead pool. Lead-calcium alloys are very prone to the loss of calcium due to oxidation at the melt surface where reactive calcium dissolved in the molten lead comes in contact with oxygen in atmospheric air.

A solution to the problems associated with calcium fade is given by the addition of minor amounts of aluminum (0.005% to 0.05%) to the lead-calcium alloy. Aluminum forms a tenacious oxide layer on the surface of the lead alloy melt thereby minimizing the oxidation of calcium.

Unlike calcium, however, the addition of aluminum to molten lead is quite difficult, being hindered by two factors:

a) a tenacious thin oxide film on the surface of solid aluminum metal which retards its dissolution rate in lead, and b) aluminum's extremely low solubility in molten lead. At typical lead processing temperatures (400°–600° C.), the maximum solubility of aluminum in molten lead is only marginally higher than specifications for calcium-aluminum-lead alloys (up to 0.05% Al).

To add pure solid aluminum metal to lead effectively, the molten lead temperature has to be raised above aluminum's melting point (660° C.) which is considerably higher than the normal range for lead processing. Due to its reactive nature, calcium metal is usually added at about 420° C. Hence there is an incompatibility between the melt temperatures at which solid aluminum and calcium metals can be added. Alternatively, premelted liquid aluminum can be poured and stirred into the lead bath; however, this requires a second furnace to melt the aluminum.

All of these higher temperature addition methods suffer from excessive oxidation, flaring and fuming leading to health and environmental concerns due to the presence of lead oxide fumes in the atmosphere. Because of the high melt temperatures, calcium recoveries are generally low, averaging below 85%, with aluminum recoveries ranging between 45% to 65%.

Other more environmentally acceptable methods have been developed, the most common utilizing the simultaneous addition of calcium and aluminum in the form of a eutectic alloy. An example of such a process is described in U.S. Pat. No. 4,439,398 to Prengaman issued Mar. 27, 1984. A suitable low melting point (545° C.) eutectic alloy forms at 73% Ca/27% Al.

The eutectic alloy allows for simultaneous addition of calcium and aluminum in a ratio of approximately 3 Ca:1 Al at molten lead temperatures of about 570° C. Typically, reagent recoveries with this alloy are higher than for the pure calcium and aluminum metal addition practices outlined above; calcium and aluminum recoveries of 90% and 70% respectively can be expected with the alloy. The major difficulty arising with the use of this alloy is, however, that the addition ratio is 3 Ca:1 Al which often does not correspond to the proportion of calcium and aluminum required by the lead alloy specifications. In many cases, the desired Ca:Al ratio in the final lead alloy can be as high as 10:1. Achieving this addition ratio is difficult with an alloy of Ca and Al since the melting points of these alloys increase sharply on either side of the 73% Ca, 27% Al eutectic. These elevated melting points make off-eutectic alloys difficult to produce and difficult to use since the lead bath temperature must be increased accordingly. The disadvantages of higher lead temperatures include higher energy costs, longer processing times, shorter kettle life, higher calcium fade and increased lead oxide fume emissions.

Other technologies have also been developed to add aluminum and calcium to molten lead. U.S. Pat. No. 4,808,376, issued Feb. 28, 1989 to Worcester et al., adds calcium and aluminum powders by injecting a mixture carried by a stream of inert gas through a hollow lance which is submerged in a bath of molten lead. Because of the large density difference between the calcium and aluminum powders and liquid lead, the lance has to be equipped with a perforated canister at its tip. This canister acts to capture and hold the rising calcium and aluminum powders as they exit the lance. With this technique, calcium and aluminum recoveries are typically 90% and 55% respectively. This process still suffers from low aluminum recoveries and requires complicated and costly submerged injection equipment including the use of lances which are prone to plugging problems.

U.S. Pat. No. 4,627,961, issued Dec. 9, 1986 to Dudek, calls for the simultaneous addition of calcium and aluminum by compressing a mechanical mixture of the respective metal granules into a briquette. The briquettes are then added into a vortex created by stirring molten lead at temperatures between 550° and 600° C. The major difficulty with this method is unpredictability in the amount of calcium and aluminum recovered in the melt. Trials with calcium/aluminum briquettes, described in column 1 of aforesaid U.S. Pat. No. 4,808,376, show highly variable results with calcium recoveries varying by up to 10% and aluminum recoveries varying by over 34%.

U.S. Pat. No. 4,699,764, issued Oct. 13, 1987 to Tobias et al., describes a complicated system where lead is melted in a separate holding furnace which is connected to a dissolution furnace by heated feed and return pipes. A pump is used to move the molten lead through the heated feed pipe in which the lead temperature is increased to the desired alloying temperature. The heated lead then passes through the dissolution furnace where it alloys with the addition reagents such as aluminum. The alloyed lead is then returned via the second pipe to the main lead holding furnace. The molten lead is continually circulated until the desired alloy composition is attained. This process is not only complicated but uses pumps and heated pipes which are maintenance intensive items.

In summary, while the addition of calcium metal to lead is relatively straightforward with recoveries of 90% or better expected, the addition of aluminum metal to molten lead is quite difficult. All processes which add pure aluminum metal at melt temperatures of 660° C. or less (that is below the melting point of aluminum) suffer from low and highly variable aluminum recoveries. Many require complicated, costly and maintenance intensive equipment. At lead melt temperatures above aluminum's melting point, aluminum recoveries improve but the excessive heat leads to higher energy costs, longer processing times, shorter kettle life, higher calcium fade and excessive fuming of lead oxide causing serious environmental concerns.

SUMMARY OF THE PRESENT INVENTION

The present invention utilizes a simple system for simultaneous addition of calcium and aluminum metals at normal lead processing temperatures (typically 560° C. and in any event below 660° C.) with high and predictable recoveries and minimal oxidation and fume emissions.

High and predictable aluminum recoveries at melt temperatures below 660° C. are unexpected since all previously described technologies resulted in low and/or highly variable aluminum recovery. In this regard, U.S. Pat. No. 4,808,376 which adds pure calcium and aluminum metals by simultaneous addition through a submerged lance achieved average aluminum recoveries of 55% ranging between 44% and 62.5%. The preferred range of lead melt temperatures with this technology is between 550° C. to 580° C.

Trials utilizing pure calcium/aluminum metal briquettes, reported in aforesaid U.S. Pat. No. 4,808,376, column 1, were highly unpredictable reporting aluminum recoveries of on average about 71% but with a variability of ±17% giving a 34% swing in aluminum levels. Lead bath temperatures of at least 550° C. are recommended.

Other methods for adding pure aluminum required that the lead be heated to temperatures above 660° C. or that molten aluminum be added to the lead bath. These high temperature methods result in high calcium fade and excessive lead oxide fuming.

The present invention makes use of the exothermic release of heat provided when calcium metal dissolves in molten lead. When adding calcium particles, the heat release associated with calcium dissolution will cause a sharp local increase in the temperature of the lead surrounding the dissolving calcium particles. Since high melt temperatures are required to dissolve aluminum in lead, any aluminum particles coming in contact with the locally superheated lead adjacent to a calcium particle will dissolve rapidly.

To facilitate this increased aluminum dissolution rate, it is necessary to ensure that the calcium and aluminum particles are always maintained in close proximity with each other so that the heat released from the dissolving calcium particles is readily available to superheat the lead directly adjacent to an aluminum particle.

None of the previously described prior art for adding aluminum and calcium to molten lead at melt temperatures below about 660° C. is designed to ensure calcium and aluminum particles are held within close proximity to each other throughout the dissolution reaction.

In accordance with a first aspect of this invention, a process for adding calcium and aluminum to molten lead comprises feeding calcium and aluminum particles into the interior of a tubular housing having a wall extending down into the molten lead and having a bottom opening at a relatively large depth below the lead surface and having top openings in its wall at a relatively small depth below the lead surface; and, using a rotary impeller positioned in said tubular housing to cause swirling of the lead carrying the particles within the tubular housing, the shape of the housing and the nature and position of the impeller being such as to ensure that lead carrying the particles is swirled against the housing wall and recirculated within the housing before the lead leaves either the top or bottom openings.

As indicated above, the temperature of the lead bath will normally be less than 660° C.

A further aspect of the invention is an apparatus for introducing calcium and aluminum into molten lead, comprising a generally vertical tubular housing and support means for holding the tubular housing so that an upper portion of the tubular housing is above the lead surface while a lower portion is submerged in the lead, said lower portion having a wall with openings capable of being held a short depth below the lead surface, said lower portion having a bottom opening at its lower end and capable of being positioned at a relatively large depth below said surface. The upper openings are shrouded with a canopy which extends below the bottom of these openings. The apparatus also has supply means for feeding calcium and aluminum particles into the upper portion of the tubular housing. An impeller is mounted on a rotary shaft extending down into the tubular housing, the shape of the housing and the nature and position of the impeller being such as to ensure that lead carrying the particles is swirled against the housing wall and recirculated within the housing before the lead leaves the tubular housing.

As indicated, proper swirling of the lead is partially dependent on the shape of the housing and partially dependent on the nature and position of the impeller. The housing is constricted to impede flow of lead through the bottom opening and to assist in recirculation. Preferably, the lower portion of the tubular housing converges downwardly, providing a conical constriction leading to an outlet opening which may be about one half the maximum diameter of the housing and may be less than the impeller diameter. This helps to promote radial liquid flow to ensure that the calcium and aluminum particles are held in the tubular housing for an adequate length of time.

The design and location of the impeller is critical to establishing optimum liquid flow patterns inside the tubular housing. In the preferred embodiment, the impeller is located inside the housing just above the bottom opening, or at least closer to the bottom outlet than to a mid point of the downwardly converging portion. With this design, net liquid flow is downwards with liquid lead drawn in from the bulk melt through the top openings, swirled around inside the housing and forced out through the bottom opening. In this embodiment, the conical constriction in the bottom portion of the tubular housing is extremely important since it restricts the flow of lead through the bottom opening and thereby promotes radial flow. Without this constriction in the diameter of the tubular housing, the vortex would favour more axial flow thereby enabling calcium and particularly aluminum solid particles to escape the housing before being completely dissolved into the lead.

In a second embodiment, the impeller is located near the point of constriction inside the tubular housing. With this design, flow inside the housing reverses with liquid lead from the bulk melt being drawn in through the bottom opening and passing out of the top openings. In this case, the canopy above the top openings ensures that any unreacted calcium and aluminum particles which may be inadvertently discharged through the top openings are caught in the canopy because of their high buoyancy relative to lead and are thereby prevented from floating to the surface of the lead bath where they would be lost as unreacted reagent.

In each case, the impeller is, of course, between the top and bottom openings.

Unlike in U.S. Pat. No. 3,741,754 aforesaid, which uses a marine type impeller to produce axial flow, the rotary impeller used in both embodiments herein is preferably at least partially of the centrifugal type, so that the lead in the region of the impeller is caused to move both radially and axially and to strike the walls of the tubular housing, and to swirl around adjacent to the wall before leaving the outlet. Also, unlike in the aforesaid '754 patent, the tubular housing is constricted in diameter so as to decrease axial flow and promote more radial flow within the housing. This is an important aspect of the present invention since it increases residence time of the aluminum and calcium particles inside the tubular housing. These features ensure that the particles are held within the tubular housing and retained in contact with a relatively small volume of lead while the exothermic reaction between the calcium heats this volume of lead to a temperature at which the aluminum dissolves.

While the invention is principally concerned with addition of particles of aluminum and calcium metals to the lead, the same process and apparatus can be used to add particles of aluminum/calcium alloy to lead, or a mixture of alloy and metal.

BRIEF DESCRIPTION OF THE DRAWINGS

The present invention will further be described with reference to the accompanying drawings, in which.

DETAILED DESCRIPTION

Figure 1:
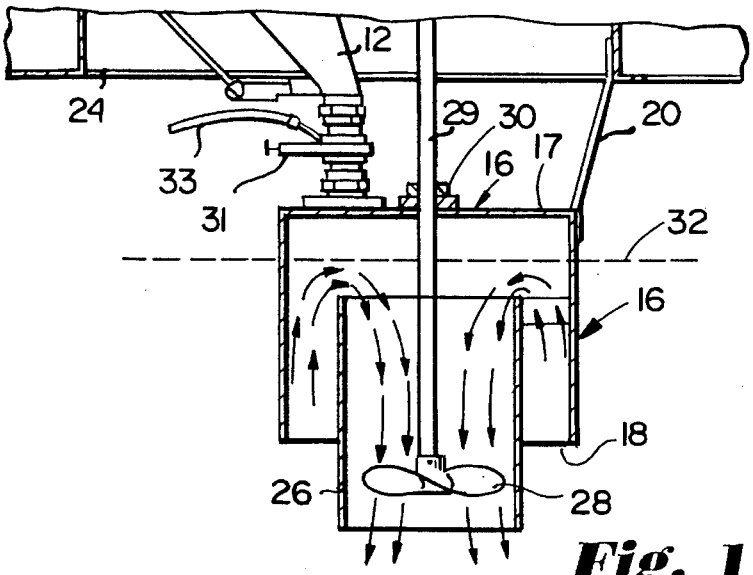
Fig. 1 (PRIOR ART)
FIG. 1 is a partial view of prior art apparatus shown in U.S. Pat. No. 3,741,754 as aforesaid.

FIG. 1 shows the essential elements of prior art U.S. Pat. No. 3,741,754 used for adding reactive metal, such as calcium, to molten lead while using a protective gas covering provided by an inert gas. As shown, a supply chute 12 forming the lower end of a feed hopper is used to deliver a supply of the reactive material. A cylindrical housing 16 which is closed at its top end 17 and open at its bottom end 18 is supported by support arm 20 from a movable frame 24. An inner chamber 26 is centrally disposed within housing 16. Within chamber 26 is located an impeller 28 of the marine or axial flow type attached to rotary shaft 29, which shaft extends up through gland 30 and has its upper end driven by a motor/gear box combination also mounted on frame 24. A vibrator 31 is connected to the base of chute 12 to assist flow of the reactive metal into the lead bath 32. An inert gas stream is provided through supply conduit 33; this assists movement of reactive particles into the top of housing 16. Frame 24 is arranged to be movable over a molten metal bath to be treated.

In use, the frame 24 is positioned to insert part of housing 16 and all of inner chamber 26 below the surface 32 of the molten lead. Inert gas is supplied through conduit 33, and the lead temperature adjusted to 900° to 950° F. (i.e. 482° to 510° C.). Calcium particles are supplied at a rate of about 15 pounds per minute, while the impeller 28 is rotated at about 280 rpm to produce a deep vortex in the bath. The impeller tends to pull liquid lead upwardly through the annular space between the housing 16 and the inner chamber 26 and then downwardly through the chamber and out through its bottom outlet into the bath. The calcium particles are mixed with the molten lead during this movement. Using this apparatus, calcium-lead alloys were reportedly made ranging in calcium content from about 0.025% to 1.5% by weight calcium, based on the combined weight of calcium and lead in the alloy. The prior patent also reported that the addition of 6 mesh calcium nodules at a rate of about 15 pounds per minute to a lead bath at 480°–510° C. produced calcium recovery of about 88% by weight; i.e. about 88% of all calcium input became a part of the calcium-lead alloy.

At a preliminary stage of this invention, experiments were conducted to determine if the method as described in U.S. Pat. No. 3,741,754 could be adapted to also add aluminum metal to lead. A reaction vessel similar to that reported in the patent and as shown in FIG. 1 herein was constructed. The reagent feed system was altered to facilitate the addition of:

calcium and aluminum metal particles simultaneously, or, only aluminum metal particles.

Tests with this method, but at a temperature of 560° C., showed that when aluminum metal was added separately, that is without calcium addition, the aluminum recovery was zero. Hence this method is unsuitable for adding only pure solid aluminum metal particles to molten lead at processing temperatures customarily used for producing lead acid battery alloys.

Tests were also conducted using this method for simultaneously adding calcium and aluminum particles to the lead bath; the results are shown in Table 1 below.

TABLE 1

Calcium and Aluminum Metal Recoveries with Simultaneous Addition Using the Method Described in U.S. Pat. No. 3,741,754

| Lead Temp. °C. | Number of Tests | % Recovery Calcium | % Recovery Aluminum |
|---|---|---|---|
| 500 | 4 | 86.6 ± 17.4 | 39.0 ± 19.9 |
| 540 | 3 | 90.6 ± 6.0 | 48.8 ± 7.2 |
| 560 | 9 | 91.9 ± 6.8 | 60.0 ± 9.6 |

The results in Table 1 prove that when aluminum and calcium particles-are moved within close proximity to each other inside a well stirred cylindrical reaction bell or housing, the heat released by calcium dissolution locally increases the lead temperature in the vicinity of the aluminum particles, thereby facilitating aluminum dissolution which would not have normally taken place in the absence of calcium.

The data in Table 1 indicate that with the method described in U.S. Pat. No. 3,741,754 altered to feed both solid calcium and solid aluminum metal particles, calcium and aluminum recoveries both increase as the lead bath temperature increases from 500° C. to 560° C. However, the results also show that there still remains a high degree of variability in test-to-test aluminum recovery; at best ±9.6%. In addition, while the calcium recoveries are excellent, in the 90% range, this method still yields aluminum recoveries which average only 60% which are not greatly better than the other methods described in the previous prior art for adding solid aluminum metal to lead.

As mentioned previously, in preliminary experiments with the cylindrical housing, when calcium was not added, aluminum recovery was 0%. Furthermore, unreacted particles of aluminum were observed floating on the surface of the bulk lead bath outside of housing 16. This indicated that the design described in U.S. Pat. No. 3,741,754 results in unreacted particles of aluminum being forced out of the open bottom of the cylindrical housing by the vortex created by the impeller. This is not a problem in the original invention described in the '180 patent when using only calcium particles since calcium dissolves quite easily and rapidly in molten lead. Aluminum, on the other hand, dissolves very slowly in molten lead and hence the aluminum reagent must be maintained in close proximity with calcium particles inside the well stirred reaction zone within the housing or bell. Particle retention time inside the housing or bell must be as long as possible to promote dissolution.

In summary, altering the method described in U.S. Pat. No. 3,741,754 to allow for the addition of both solid calcium metal and solid aluminum metal into molten lead, confirmed that the localized heat released during calcium dissolution was sufficient to facilitate aluminum metal dissolution. However, the method described in this '754 patent was inappropriately designed to maximize calcium and aluminum particle retention time inside the bell or cylindrical housing. The ejection of unreacted metal particles through the open bottom of the housing was believed to be responsible for low and variable aluminum recoveries with the results being unpredictable from test-to-test.

Figure 2:
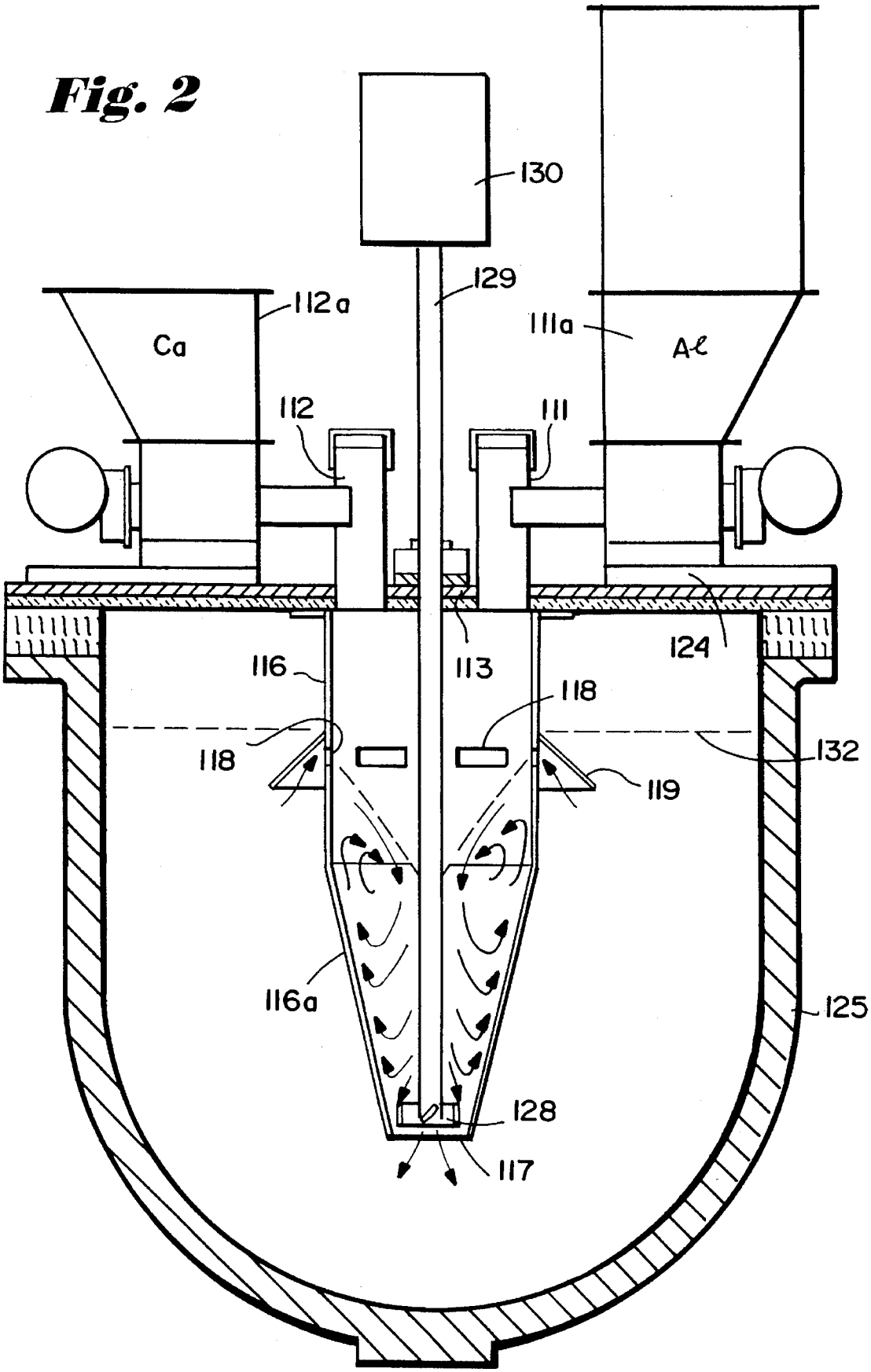
FIG. 2 is a sectional elevation of apparatus in accordance with a preferred embodiment of this invention.

FIG. 2 shows the preferred embodiment of apparatus in accordance with the invention which has been found to overcome the shortcomings of the prior art apparatus of FIG. 1.

In FIG. 2, two supply chutes 111 and 112 are provided from two separate hoppers 111*a* and 112*a* for calcium and aluminum particles or for calcium/aluminum alloy particles. These chutes pass into the otherwise closed top 113 of tubular housing 116 having an open bottom end outlet 117. The chutes can, if required, also be used for the introduction of a protective inert gas into the top of the housing. The housing and chutes are carried by support means comprising a frame part 124 which can be moved into place as required over a vessel 125 containing a batch of the molten lead, the upper surface of which is indicated at 132.

The closed top 113 accommodates drive shaft 129 of motor 130 which carries impeller 128 at its lower end.

The housing 116 has a series of top openings in the form of slots 118 around its periphery, which provide inlet means located at relatively small depth below the surface 132 of the lead; i.e. a depth which is small relative to that of the bottom outlet 117. A downwardly diverging frusto-conical deflector or canopy 119 is fixed to the outer surface of the housing 116 just above the slots 118; this ensures that melt entering the slots is not contaminated with surface dross or the like.

The essential differences between this invention and that of the '754 patent lie in the nature of the impeller 128 and the design of the housing 116. The impeller, instead of being a marine or axial flow type propeller, as shown in the '754 patent, is at least partially of the centrifugal flow type. Specifically, the blades of the impeller are set at an angle of between 40° and 50° to the horizontal impeller plane in which the blades rotate, preferably about 45°; rather than the shallower angle usual with axial flow type impellers. Accordingly, Applicants' impeller provides both substantial radial flow as well as axial flow; axial flow ensures that lead is drawn into the housing through top openings 118 and is moved through the housing while centrifugal flow ensures that it is swirled around in the housing long enough to become alloyed with the calcium and aluminum. An impeller of this kind may be termed a modified turbine impeller. Also, while the axial flow impeller in the '754 patent was more than two thirds the internal diameter of the housing, in the present invention the impeller diameter is less than one-half the diameter of the cylindrical portion of the housing 116, which is the maximum diameter of the housing, and is preferably slightly smaller than the diameter of the bottom outlet. Furthermore, while in the '754 patent the housing is wholly cylindrical in shape, applicants' housing 116 is cylindrical in the upper portion which contains the inlet slots 118 and constricted by a frusto-conical lower section 116*a*. This constriction impedes the flow of liquid metal out of the bottom outlet thereby further promoting radial flow inside the housing and reducing axial flow which has been shown in the preliminary experiments with the cylindrical housing 16 to result in low, unpredictable aluminum recoveries due to undissolved aluminum particles being discharged through the bottom opening.

In operation, the combined effects of a turbine type impeller 128 rotating at sufficient speed e.g. about 400–600 rpm and the constricted frusto-conical lower housing 116*a* cause the lead to flow in both axial and radial directions as indicated by the arrows with lead entering inlets 118, being swirled around by the impeller, and finally leaving from the bottom opening. Calcium and aluminum particles are fed simultaneously or in close sequence into the interior of the housing via chutes 111 and 112. It will be seen that the turbine impeller in combination with the frusto-conical constriction create a vortex with sufficient radial flow such that particles of the feed metals are caused to swirl around within the housing between the wall and the impeller, and above the impeller, and this ensures close proximity of the calcium and aluminum particles and maximizes their retention time within the housing. During this motion the exothermic reaction between the calcium and the lead heats the lead within the housing and adjacent to the particles and this causes dissolving of the aluminum.

During the operation, protective gas if desired can be introduced into the housing through chutes 111 and 112 or by a separate inlet port. While the use of a protective gas is not essential, tests show that use of an inert gas such as argon will improve calcium recovery by as much as 15 to 20%.

Tests, described below, have shown that results achieved with the method and apparatus as described, in terms of aluminum recovery in particular, are much better than with apparatus as shown in the '754 patent.

EXAMPLE 1

A conical housing similar to that shown in FIG. 2 was inserted into a 1250 kg molten lead bath. The lead melt was initially maintained at 560° C. 1.45 kg of calcium metal particles and 0.21 kg of aluminum metal particles were added simultaneously to the lead vortex generated with the impeller operating at 600 rpm inside the conical reaction housing. The reagents were introduced into the melt over a 7 to 8 minute time interval. Stirring inside the housing continued for up to 20 minutes from the start of reagent feeding. Samples were taken for chemical spectrographic analysis from the bulk lead pool outside the housing at 0, 5, 10 and 20 minute intervals from the start of reagent feeding. The results below indicate that, with the housing and impeller combination with this preferred embodiment, calcium recovery reached 92.7% by 10 minutes and 96.1% after 20 minutes. Aluminum recovery is exceptionally high reaching 81.6% at 10 minutes and increased to 82.7% after 20 minutes.

The change in calcium and aluminum levels between 10 and 20 minutes is considered insignificant; hence dissolution with the housing was complete at 10 minutes, that is within 2 to 3 minutes after end of reagent feeding.

EXAMPLE 2

The exact same experiment as described in Example 1 was repeated to confirm calcium and aluminum particle dissolution and recovery with the apparatus of this invention as described. Once again, dissolution was complete at the 10 minute mark, that is within 2 to 3 minutes after the end of reagent feeding. Final calcium analyzed at 1050 ppm (92.3% recovery) and the aluminum analyzed at 165 ppm (98.2% recovery).

These results confirmed that the constricted frustoconical housing and impeller arrangement of this preferred embodiment of the invention significantly increases the recovery of aluminum encountered with the prior art arrangement. With this preferred embodiment of the present invention aluminum recoveries increased to between 83 to 98% which is substantially higher than either the 60% aluminum recoveries achieved with the cylindrical housing design in the '754 patent or the aluminum recoveries reported in the other prior art cited in this disclosure. This is attributed to the tangential fluid flow developed inside the new housing which ensures the close proximity of the aluminum and calcium particles at the periphery of the housing and increases particle retention time inside the housing. Both of these factors are necessary if the localized heat released during calcium dissolution in lead is to be effectively recovered and used to promote aluminum metal dissolution at lead melt temperatures below 660° C. No unreacted aluminum particles were observed in the bulk metal pool outside the housing when the new arrangement was used as was the case with the prior cylindrical housing of the prior patent.

Figure 3:
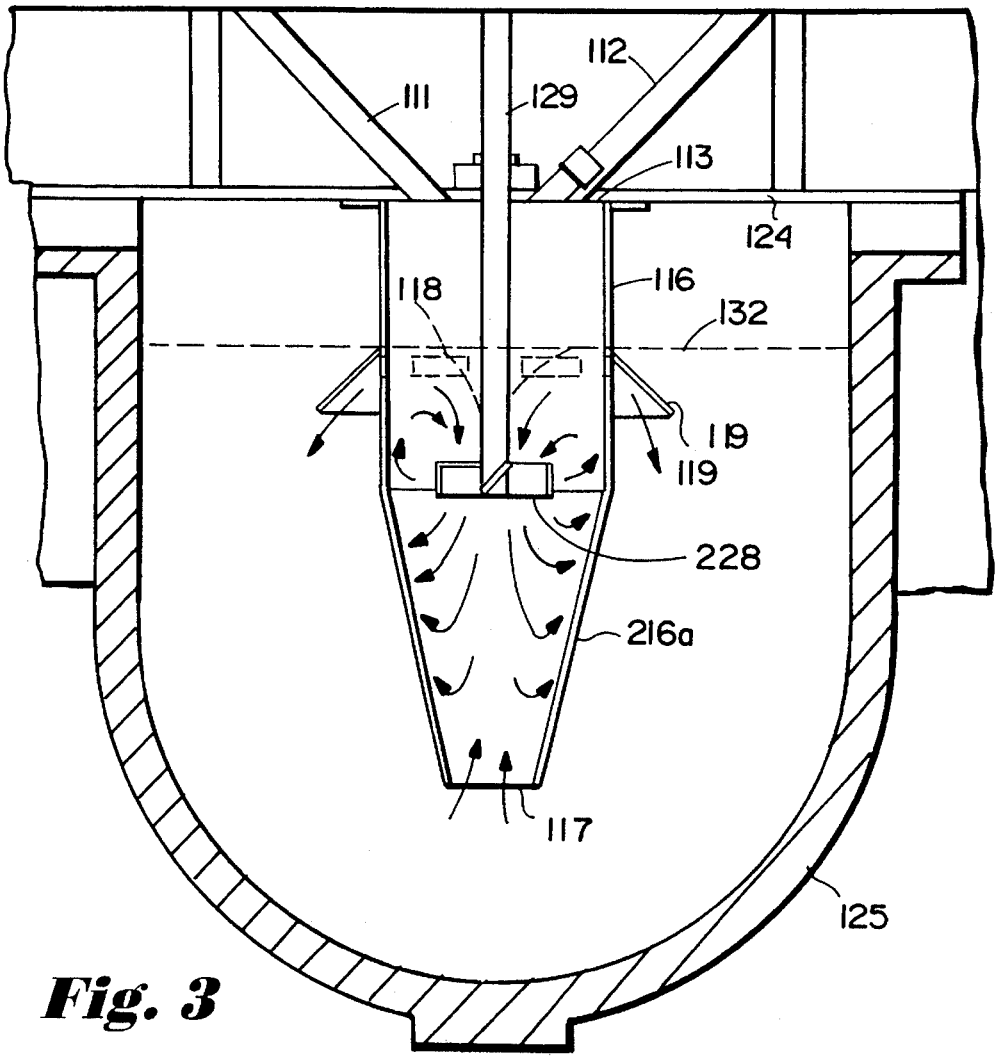
FIG. 3 is a sectional elevation of apparatus in accordance with a second embodiment of this invention.

A second embodiment of this invention as shown in FIG. 3, in which the same reference numerals are used for parts which are the same as those of FIG. 2. The FIG. 3 arrangement allows for the turbine impeller 228 to be located approximately at the elevation where the cylindrical portion of the housing meets the constricted portion 216*a*. As in the preferred embodiment, the impeller design and the frusto-conical lower section of the housing promote combined axial and radial flow patterns as shown by the arrows in FIG. 3. In this case, however, it has been found that raising the position of the impeller results in a reversal of the metal flow with liquid lead flowing in through the bottom opening and out the top openings. As before, rotating impeller 228 at sufficient speed e.g. about 400 to 600 rpm, in combination with the conical design of the housing, creates flow patterns whereby the feed metal particles swirl around within the housing between the wall and the impeller. However, in this embodiment, the buoyant forces acting on the calcium and aluminum particles may act to cause them to float out of the housing through the top openings. The design of the frusto-conical canopy 119 ensures that any undissolved particles exiting through the upper holes are caught prior to floating to the surface of the melt where they would be unrecovered due to oxidation. Nevertheless, this embodiment does not ensure as close a proximity of calcium and aluminum particles and as long a retention time within the housing as the preferred embodiment.

Tests described below with this less preferred embodiment show excellent reagent recoveries. While the recovery of aluminum is significantly better than either the preliminary experiments with the cylindrical housing as described in the '754 patent or those reported in the other prior art, it is somewhat below that reported in Example 2 with the preferred embodiment of this invention.

EXAMPLE 3

A conical housing similar to that shown in FIG. 3 was inserted into a 1250 kg molten lead bath. The lead melt was initially maintained at 560° C. 1.48 kg of calcium metal particles and 0.21 kg of aluminum metal particles were added simultaneously to the lead vortex generated with the impeller operating at 600 rpm inside the conical reaction housing. The reagents were introduced into the melt over a 7 to 8 minute time interval. Stirring inside the housing continued for up to 20 minutes from the start of reagent feeding. Samples were taken for chemical spectrographic analysis from the bulk lead pool outside the housing at 0, 5, 10 and 20 minute intervals from the start of reagent feeding. The results below indicate that, with the housing and impeller combination of this invention, calcium recovery reached 92.7% by 10 minutes and 96.1% after 20 minutes. Aluminum recovery reached 83.2% at 10 minutes and remained unchanged after 20 minutes.

| Sample | Analysis, ppm | | Recovery, % | |
|---|---|---|---|---|
| Time | Ca | Al | Ca | Al |
| 10 | 1100 | 140 | 92.7% | 83.2% |
| 20 | 1140 | 140 | 96.1% | 83.2% |

The 40 ppm increase in calcium levels between 10 and 20 minutes is considered insignificant; hence dissolution with the housing was complete at 10 minutes, that is within 2 to 3 minutes after end of reagent feeding.

EXAMPLE 4

The exact same experiment as described in Example 3 was repeated to determine the reproducibility of calcium and aluminum particle dissolution and recovery with the apparatus of this invention. Once again, dissolution was complete at the 10 minute mark, that is within 2 to 3 minutes after the end of reagent feeding. At 10 minutes, the calcium analyzed at 1068 ppm (90% recovery) and the aluminum analyzed at 140 ppm (83.2% recovery).

The results using the present invention as reported in Examples 1, 2, 3 and 4 confirm that the combination of a turbine impeller rotated at sufficient speed and a housing constricted by a frusto-conical section at its base result in substantial improvements in aluminum recovery, as compared to what can be achieved with the apparatus of the '754 patent. The position of the impeller inside the housing and the design of the impeller will determine the direction of metal flow that is either in from the top and out the bottom or vice versa. Aluminum recovery is substantially better than the prior art with both design modifications.

The improvement in recovery is attributed to the radial flow developed inside the new housing design which ensures close proximity of the aluminum and calcium particles and increases particle retention time inside the housing. Both of these factors are necessary if the localized heat released by calcium dissolution in lead is to be effectively recovered and used to promote aluminum metal dissolution at lead melt temperatures below 660° C. Aluminum recoveries were between 38% to 63% higher with the present invention compared to those obtained with experiments utilizing the cylindrical housing of the '754 patent.

Furthermore, with the present invention no unreacted aluminum particles were observed in the bulk metal pool as was the case with the cylindrical housing of the prior patent.

The results obtained with the FIG. 3 arrangement indicate that use of a turbine type impeller, i.e. one designed to cause some axial flow, is not essential, since overall flow occurs against the downwards flow direction imparted by the impeller. Accordingly, it is believed that a straight-bladed, centrifugal-type impeller, suitably positioned in the housing, could also provide satisfactory results.

We claim:

1. A process for making a lead-calcium alloy by adding calcium and aluminum materials to molten lead, and which uses a generally vertical tubular housing for mixing the material with lead, said housing having a movable support therefor and having a wall with top opening means and having a bottom opening, comprising:

placing the movable support over a vessel containing a batch of the molten lead, so that said wall of said tubular housing extends down into the molten lead sufficiently far so that the top opening means are below the surface of the lead;

feeding particles of calcium and aluminum metal or alloys thereof into the interior of said tubular housing; and using a rotary impeller positioned in said tubular housing between its top opening means and bottom opening to cause the molten lead to be drawn from the vessel into the housing and to be returned back into the vessel, said impeller having blades rotating in a horizontal plane and set at an angle of at least 40° to said horizontal plane and having a diameter less than one half the maximum diameter of the housing;

the shape of the housing and the nature and position of the impeller being such as to ensure that molten lead carrying the particles is swirled against the housing wall and recirculated within the housing before the lead leaves the housing.

2. A process according to claim 1, wherein the temperature of the lead is less than 660° C.

3. A process according to claim 1, wherein the impeller and its position in the housing, are such that the lead is drawn in through the top opening means, and, after mixing with the materials, leaves the housing through the bottom opening, and wherein flow through the bottom opening is impeded by providing a constriction in the lower part of the tubular housing, which constriction is between one half and one third the maximum diameter of the housing.

4. A process according to claim 3, wherein a major part of the swirling of said particles takes place above said impeller in a downwardly converging zone of said tubular member, the impeller being positioned below the mid point of said converging zone.

5. A process according to claim 1, wherein the said angle of the blades is between 40 ° and 50°.

6. A process according to claim 1, wherein the bottom opening is about one-half the maximum diameter of the housing.

7. A process for making a lead-calcium alloy by adding calcium and aluminum materials to molten lead, and which uses a generally vertical tubular housing for mixing the material with lead, said housing having a movable support therefor and having a wall with top opening means and having a bottom opening, comprising:

placing the movable support over a vessel containing a batch of the molten lead, so that said wall of said tubular housing extends down into the molten lead sufficiently far so that the top opening means are below the surface of the lead;

feeding particles of calcium and aluminum metal or alloys thereof into the interior of said tubular housing; and using a rotary impeller positioned in said tubular housing between its top opening means and bottom opening to cause the molten lead to be drawn from the vessel into the housing and to be returned back into the vessel, said impeller having a diameter less than one half the maximum diameter of the housing;

the shape of the housing and the nature and position of the impeller being such as to ensure that molten lead carrying the particles is swirled against the housing wall and recirculated within the housing before the lead leaves the housing;

and wherein the flow through said bottom opening is impeded by providing a constriction in the lower part of the tubular housing, which constriction is between one half and one third the maximum diameter of the housing.

* * * * *